United States Patent [19]

Girdler

[11] 4,024,585

[45] May 24, 1977

[54] TIE CLASP

[75] Inventor: George W. Girdler, Fort Lauderdale, Fla.

[73] Assignee: Jack Steinberg, Hialeah, Fla. ; a part interest

[22] Filed: Mar. 15, 1976

[21] Appl. No.: 666,962

Related U.S. Application Data

[63] Continuation-in-part of Ser. No. 613,172, Sept. 15, 1975, Pat. No. 3,958,277.

[52] U.S. Cl. ..... 2/153

[51] Int. Cl.[2] ..... A41D 25/08

[58] Field of Search ..... 2/150, 152 R, 152 A, 2/153, 145, 148, 149, 154, 137; 24/153 BP

[56] References Cited

UNITED STATES PATENTS

| | | | |
|---|---|---|---|
| 3,365,726 | 1/1968 | Pulitzer | 2/153 |
| 3,588,918 | 6/1971 | Thistle | 2/153 |
| 3,631,541 | 1/1972 | Williams | 2/153 |
| 3,820,166 | 6/1974 | Gouner | 2/153 |
| 3,964,105 | 6/1976 | Gideon | 2/152 R |

*Primary Examiner*—G. V. Larkin

*Attorney, Agent, or Firm*—Robert B. Kennedy

[57] ABSTRACT

A tie clasp for supporting neckwear comprising a plate adapted to be positioned on the front of a shirt collar, a hook rigidly or pivotably mounted on the back of the plate for suspending the plate from the shirt collar, and receiving means having mutually spaced bars mounted on the back of the plate below the hook through which neckwear may be passed in draping the neckwear ends in mutual lateral or overlaid positions, respectively.

8 Claims, 11 Drawing Figures

TIE CLASP

REFERENCE TO RELATED APPLICATION

This is a continuation-in-part of application Ser. No. 613,172 filed Sept. 15, 1975 and now allowed and issued as U.S. Pat. No. 3,958,277.

BACKGROUND OF THE INVENTION

1. Field of the Invention:

The invention relates generally to tie clasps for supporting neckwear, and particularly to tie clasps of the type adapted to be fitted on the front of a shirt collar with an item of neckwear suspended from the back thereof.

2. Description of the Prior Art:

Heretofore, tie clasps have been devised for attachment to shirt collars between the collar wings from which neckwear may be held pendant. As exemplified by U.S. Pat. Nos. 2,774,971; 3,588,918; 3,631,541 and 3,881,196, these devices have typically comprised a plate having means for attaching the plate to the collar and a bar attached to or a slot provided in the plate forming a horizontal, upper tie support surface extending between the collar wings. With the clasp attached to a shirt collar, a necktie may be supported on the tie support surface with its end portions overlaying each other beneath the clasp.

Though tie clasps of the type just described have functioned safisfactorily in supporting neckties draped vertically from the clasps, they have not been suited for supporting other forms of neckwear such as Ascot ties, leisure or string ties or others having laterally suspended pendant ends. They have also been incapable of accommodating both neckwear sized to encircle a wearer's neck as well as that sized to bypass the neck. The prior art devices have exhibited only minimally acceptable stability in use as they have often tended to become skewed.

Accordingly, it is a general object of the present invention to provide an improved tie clasp.

More specifically, it is an object of the invention to provide a tie clasp from which neckwear ends may be draped in mutual lateral or overlaid positions.

Another object of the invention is to provide a tie clasp from which neckwear may be suspended sized either to encircle or bypass the wearer's neck.

Another object of the invention is to provide a tie clasp with means for readily affixing an ornament.

Another object of the invention is to provide a tie clasp which may be readily attached to a shirt collar and held snugly in place during use.

Yet another object of the invention is to provide a tie clasp of the type described which projects smartly outwardly from a shirt collar when attached thereto.

SUMMARY OF THE INVENTION

In one form of the invention a tie clasp is provided for supporting neckwear comprising a plate adapted to be positioned on the front of a shirt collar. Hook means are mounted on the back of the plate for suspending the plate from the shirt collar. Receiving means are also mounted on the back of the plate below the hook means through which neckwear may be passed generally horizontally or vertically in draping the neckwear ends in mutual lateral or overlaid positions, respectively. The receiving means includes a pair of parallel bars rigidly mounted to the plate back in mutual generally parallel relation.

In another form of the invention a tie clasp is provided for supporting neckwear comprising a plate adapted to be positioned on the front of a shirt collar. Receiving means, which includes a bar mounted generally horizontally to and in spaced relation with the back of the plate, is provided through which neckwear may be passed in draping the neckwear ends in mutual lateral or overlaid positions, respectively. A snap hook is further provided pivotably mounted to the plate back for pivotal movement between positions in abutment with and in spaced relation with the receiving means bar.

DESCRIPTION OF PREFERRED EMBODIMENTS

Figure 1:
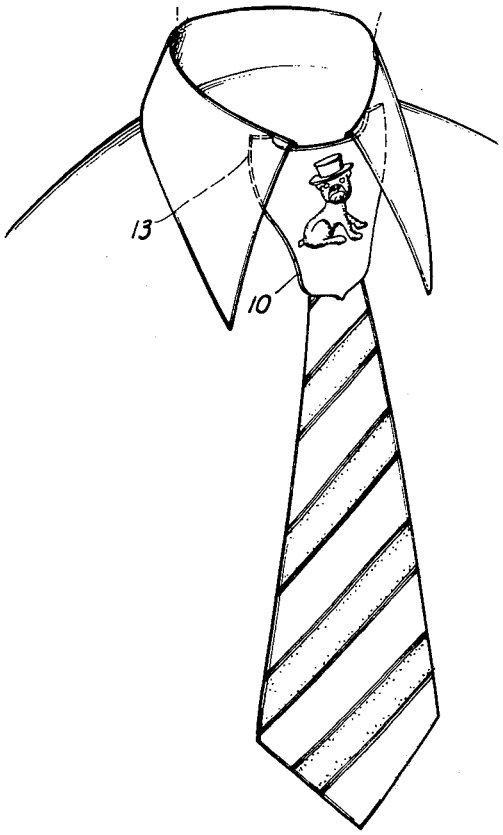
FIG. 1 is a perspective view of the front of a tie clasp embodying principles of the invention disclosed in the parent application.

Referring now in more detail to the drawing, there is shown in FIGS. 1 – 5 a tie clasp 10 comprising a metallic plate 11 formed in the general shape of a shield having bilateral symmetry. The front surface of the plate is formed slightly convexed while the rear surface is formed slightly concaved. A hook 12 is rigidly mounted to the back of the plate along its vertical centerline beneath the two upper plate corners 13. These upper corners are detailed in shape to reside snugly beneath the shirt collar wings as shown in FIG. 1.

Beneath hook 12 is also mounted to the back surface of the plate along its vertical centerline a split collar 14. This collar is pivotably mounted to the plate by means of a pivot pin 15. The split collar is provided with two mutually confronting ends 27 and 28 which define a gap 29 therebetween over pivot pin 15. The collar provides a channel 30 for receiving neckwear therethrough. A pair of guides is provided by substantially straight bars 24 rigidly mounted to the back of the plate beneath plate corners 13. As the rear surface of the plate is slightly concaved, once the ends of the bars 25 are welded to the plate the intermediate portion of the bars is spacially displaced from the plate thereby providing channels 26 between the intermediate portions of the bars and the rear surface of the plate.

An ornament 18, here in the shape of a top-hatted bulldog, is provided for mounting to the front surface of the tie clasp. A thin, square plate 21 is rigidly mounted as by welding to the center portion of the front surface of the plate 11. This thin plate 21 is provided with a central aperture which overlays an aperture formed through the surface of plate 11. From the rear of ornament 18 projects a threaded stud 19 between two mutually spaced horizontal stop bars 23. A knurled nut 20 is provided for securing the ornament snugly to the plate.

In use, ornament 18 may be readily attached to the plate by passing threaded stud 19 through the mutually aligned apertures in plates 21 and 22 with bars 23 disposed about the upper and lower surfaces of thin, square plate 21. Nut 20 may then be run up on the threaded stud 19 to firmly secure the ornament to the front surface of the plate. In tightening the nut rotary movement of the ornament with respect to the plates is inhibited by the upper and lower surfaces of plate 21 which engage stop bars 23.

Figure 3:
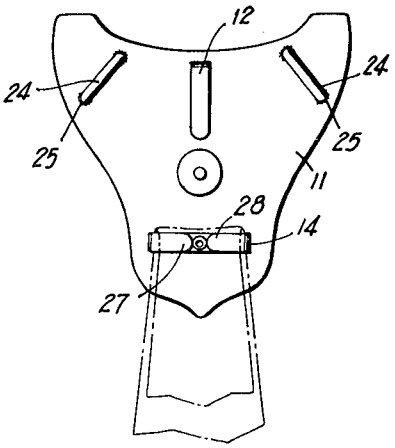
FIG. 3 is a rear elevational view of the device shown in FIG. 1 supporting a necktie with its pendant ends overlaying each other.

Once the ornament has been firmly attached to the plates, the plate itself may be secured to a shirt collar by passing hook 12 over the collar button area of the shirt collar between the shirt collar wings. In doing this the upper corners 13 are placed behind and in abutment with the collar wings. So attached, the plate is inhibited from being dislocated by the triangular arrangement of pressure points provided by hook 12 and the two upper corners of the plate disposed above the hook. A necktie may then be draped from the rear of the plate by passing it through the receiving means provided by split collar 14. In performing this the tie may be passed vertically through channel 30 or, alternatively, its midportion may be passed directly into the channel through gap 29. Once placed with its pendant ends overlaying one another, the tie assumes the position as shown in FIG. 3 with respect to the tie clasp.

Figure 2:
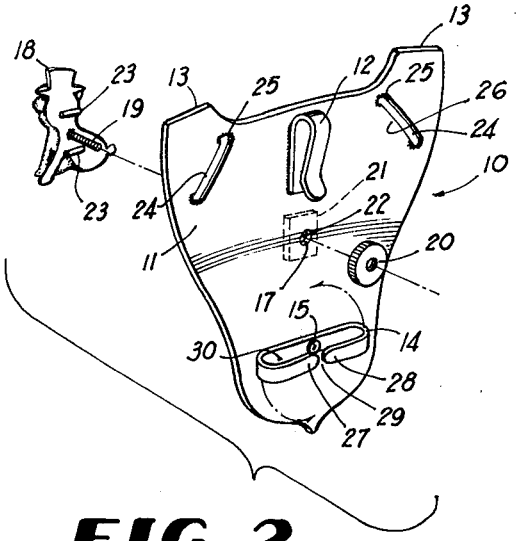
FIG. 2 is an exploded perspective view of the back of the tie clasp shown in FIG. 1.
Figure 4:
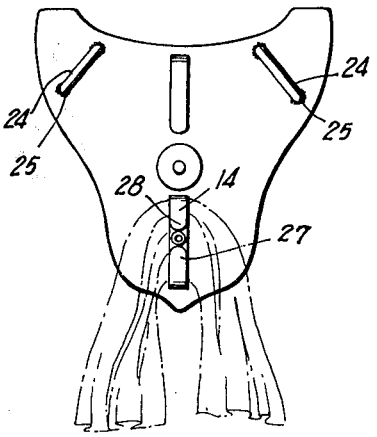
FIG. 4 is another rear elevational view of the device shown in FIG. 1 supporting Ascot type neckwear.
Figure 5:
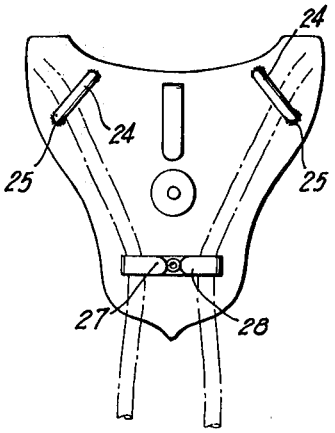
FIG. 5 also is a rear elevational view of the device shown in FIG. 1 supporting "leisure" neckwear.

For supporting a piece of neckwear with its pendant ends laterally spaced from one another, such as in the case of Ascot type neckwear, split collar 14 may be rotated, as shown by the arrows in FIG. 2, to a vertical orientation with respect to plate 11 as shown in FIG. 4. In this position neckwear may be passed generally horizontally through the channel 30 or directly into the channel through gap 29. Frictional engagement of the split collar with the rear surface of the plate inhibits the collar from rotating except at such times when substantial pressure is applied thereto as when manually gripped and rotated. Further versatility of the tie clasp is demonstrated in FIG. 5 where a leisure or string tie is seen to be supported. Here, the tie is seen to pass through both the split collar as well as beneath bars 24 and from there around the wearer's neck.

Figure 6:
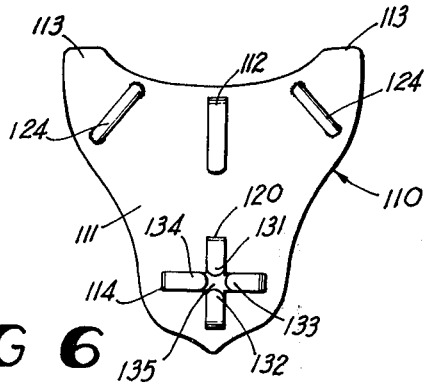
FIG. 6 is a rear elevational view of another tie clasp disclosed in the parent application.

In FIG. 6 an alternative embodiment of the invention disclosed in the parent application is shown wherein a tie clasp 110 is again seen to be in the space of a shield having bilateral symmetry to which a hook 112 is mounted to the vertical centerline thereof. Again the tie clasp plate 111 is provided with two upper corners 113 located to either side of and slightly above hook 112. In this embodiment no ornament is provided; however, again a pair of guide bars 124 is mounted about hook 112 beneath upper plate corners 113. In this embodiment the neckwear receiving means is again provided by split collar. In this case, however, the neckwear receiving means is not pivotably mounted but is rather rigidly secured to the back surface of plate 111 beneath hook 112. Here, the receiving means comprises two split collars 114 and 120 mounted normal one another. Collar 114 has two confronting, spacially separated ends 133 and 134 defining a gap 135 therebetween while collar 120 similarly has two confronting, mutually spaced surfaces 131, 132 disposed about opposite sides of gap 135. With this construction neckwear may be passed vertically or horizontally through the receiving means by passing a midportion thereof beneath the confronting ends of that split collar into which it is to be placed and above the confronting ends of the other split collar. In performing this task the other split collar also serves as a guide in positioning the intermediate portion of the neckwear within the collar.

Figure 9:
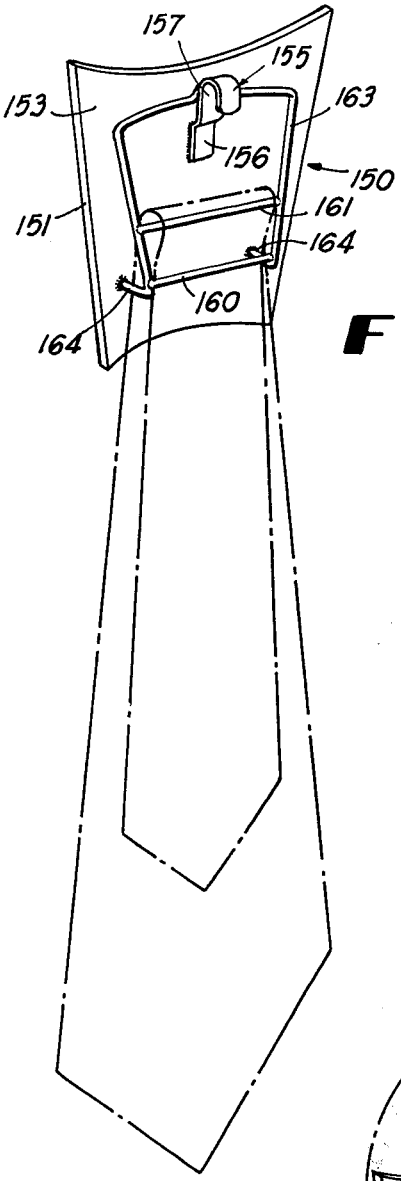
FIG. 9 is another perspective view of the tie clasp illustrated in FIG. 7 shown supporting a necktie having its pendant ends overlaying each other.
Figure 7:
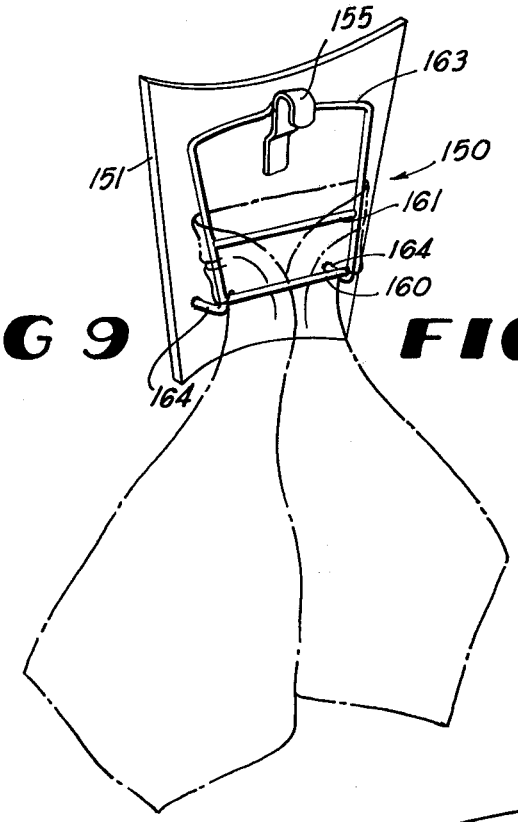
FIG. 7 is a perspective view of the rear of a tie clasp embodying principles of the present invention shown supporting Ascot type neckwear that does not encircle the wearer's neck.
Figure 8:
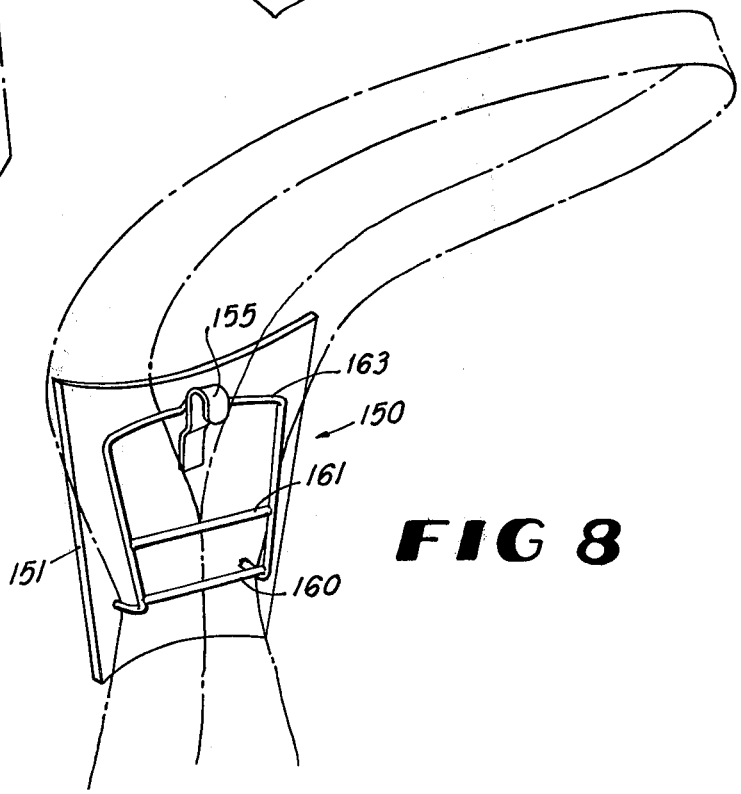
FIG. 8 is another perspective view of the tie clasp illustrated in FIG. 7 shown supporting Ascot type neckwear which encircles the wearer's neck.

With reference next to FIGS. 7 – 9 there is shown a tie clasp 150 embodying principles of the present invention comprising a metallic plate 151 again formed in the general shape of a shield having bilateral symmetry. The front surface of the plate is formed slightly convexed while the rear surface 153 is formed slightly concaved. A hook 155 is rigidly mounted to the back of the plate along its vertical centerline with a lower portion 156 of the hook welded to the plate and an upper portion 157 spaced therefrom.

Also mounted to the concaved rear surface of plate 151 is means for receiving neckwear comprising a pair of mutually parallel bars including a lower bar 160 and an upper bar 161. The receiving means further includes a connecting bar 163 which connects the parallel bars together and to the plate. The connecting bar has its two ends 164 welded directly to the plate back. A portion of the connecting bar is seen to extend over the upper bar 161 passing between and in abutment with hook 155 and the plate back 153.

In use, Ascot type neckwear may be suspended from the tie clasp by passing it, as shown in broken lines, between lower bar 160 and plate back 153, over upper bar 161 and around behind connecting bar 163. Once the clasp is secured to a shirt collar by hook 155 the frictional engagement of the neckwear and receiving means provided by the just described neckwear path is sufficient to enable a wearer to drape the pendant ends well and yet not to such an excess as to render adjustment difficult. The provision of the two parallel bars enables this compromise to be achieved.

Whereas in FIG. 7 the Ascot type neckwear did not encircle the wearer's neck, in FIG. 8 it does. In doing so the tie is seen to pass between the parallel bars and plate back and also between the connecting bar and plate. Where the thickness of the neckwear permits, it may be converged towards hook 155 thereby coming into snug gripping engagement between the plate and connecting bar which is converging upon the plate as it approaches the hook. In FIG. 9 a tie is draped from the tie clasp with its pendant ends overlaying. Here the tie is looped over the upper parallel bar 161 and passed between the lower parallel bar 160 and plate back 153. The frictional engagement created by the tie loop over the upper bar and snugness behind the lower bar provides a stable yet positionable fit.

Figure 10:
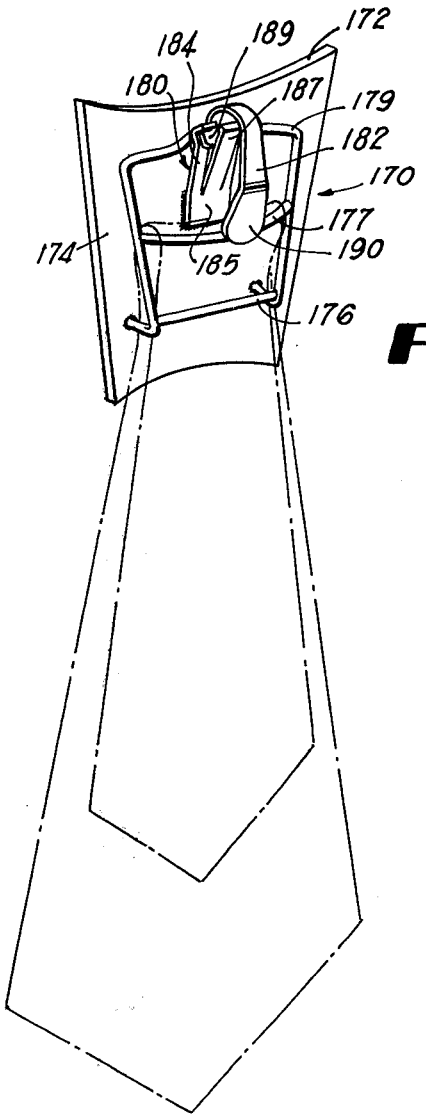
FIG. 10 is a perspective view of the rear of a tie clasp embodying principles of the present invention in another form shown supporting a necktie with its pendant ends overlaying each other.
Figure 11:
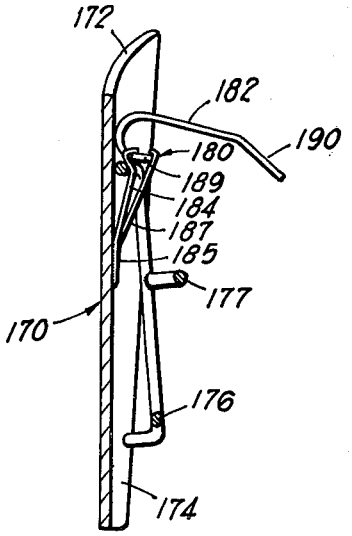
FIG. 11 is a side view in cross section of the tie clasp illustrated in FIG. 10 with its hook shown in an open position.

With reference next to FIGS. 10 and 11, a tie clasp 170 is shown embodying principles of the invention in another form. Here the clasp comprises a plate 172 of the size and shape of the just described embodiment again having receiving means secured to the rear thereof. Receiving means are again secured to the concave rear surface 174 of the plate which includes a lower bar 176 and an upper bar 177. Again these two bars are generally parallel although here the lower bar is straight while the upper bar is bowed outwardly from the plate whereby its surface facing the plate rear is itself concave. A connecting bar 179 rigidly secures the generally parallel bars to the plate.

To the rear of plate 172 is secured a conventional snap hook having a hook mount 180 and a hook 182 pivotably mounted thereto. The hook mount includes two parallel arms 184 joined together by an integral bridge 185 and straddling a resilient intermediate arm 187. The hook 182 has a table 189 seated in arcuate indentures on the ends of arms 184 distal bridge 185. So constructed, the hook may pivot with a snap-like action between an open position shown in FIG. 11 with hook end 190 spaced from bar 177 to the closed position illustrated in FIG. 10 where the hook end abuts the bar or grips neckwear looped thereover. Usage here is as described with regard to the embodiment shown in FIGS. 7 – 9 with the exception that hook 170 is opened while the clasp is being secured to a shirt collar and then snapped shut causing the hook and upper bar then to firmly grip and hold the neckwear previously draped from the clasp in place on the clasp and the clasp itself firmly in place on the collar. That the upper bar is bowed causes the clasp to project smartly outwardly from the collar.

It should be understood that the just described embodiments are merely exemplary of the invention. Many modifications, additions and deletions may be made thereto without deparature from the spirit and scope of the invention as set forth in the following claims.

What is claimed is:

1. A tie clasp for supporting neckwear comprising a plate adapted to be positioned on the front of a shirt collar; hook means mounted on the back of said plate for suspending said plate from the shirt collar; and receiving means mounted on the back of said plate below said hook means through which neckwear may be passed in draping the neckwear ends in mutual lateral or overlaid positions, respectively; and where said receiving means includes a pair of parallel bars rigidly mounted to the back of said plate in mutual generally parallel relation and a connecting bar connecting said pair of parallel bars together and to the back of said plate with said connecting bar extending between and in contact with the back of said plate and said hook means.

2. A tie clasp as claimed in claim 1 wherein said hook means includes a hook mount secured to the back of said plate in abutment with said connecting bar and a hook pivotably mounted to said hook mount.

3. A tie clasp as claimed in claim 2 wherein said hook is sized to pivotably engage one of said parallel bars.

4. A tie clasp for supporting neckwear comprising a plate having a concave back adapted to be positioned on the front of a shirt collar; hook means mounted on the back of said plate for suspending said plate from the shirt collar; and receiving means mounted on the back of said plate below said hook means through which neckwear may be passed in draping the neckwear ends in mutual lateral or overlaid positions, respectively and wherein said receiving means includes a pair of parallel bars rigidly mounted to the back of said plate in mutual generally parallel relation with the surface of one of said parallel bars facing said plate back concave whereupon being positioned on the front of a shirt collar a portion of the plate projects outwardly from the collar.

5. A tie clasp for supporting neckwear comprising a plate adapted to be positioned on the front of a shirt collar; receiving means which includes at least one bar mounted generally horizontally to and in spaced relation with the back of said plate through which receiving means neckwear may be passed in draping the neckwear ends in mutual lateral or overlaid positions, respectively and a snap hook pivotably mounted to the back of said plate for pivotable movement between positions in abutment with and in spaced relation with said receiving means bar.

6. A tie clasp as claimed in claim 5 wherein said one bar is bowed outwardly from said plate back.

7. A tie clasp as claimed in claim 5 wherein said receiving means further includes a second bar mounted to said plate back generally parallel with said one bar.

8. A tie clasp as claimed in claim 7 wherein said receiving means further includes a pair of connecting bars connecting adjacent ends of said one bar and said second bar together and with said connecting bars being mounted in spaced relation with said plate back.

* * * * *